US010183824B2

(12) United States Patent
Adachi

(10) Patent No.: US 10,183,824 B2
(45) Date of Patent: Jan. 22, 2019

(54) SHEET FEEDING APPARATUS, IMAGE READING APPARATUS AND IMAGE FORMING APPARATUS WITH SHEET FEEDING APPARATUS

(71) Applicant: CANON KABUSHIKI KAISHA, Tokyo (JP)

(72) Inventor: Seiichiro Adachi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/242,897

(22) Filed: Aug. 22, 2016

(65) Prior Publication Data

US 2017/0066618 A1 Mar. 9, 2017

(30) Foreign Application Priority Data

Sep. 7, 2015 (JP) ..... 2015-175812

(51) Int. Cl.
*B65H 3/06* (2006.01)
*B65H 3/68* (2006.01)
(Continued)

(52) U.S. Cl.
CPC ..... *B65H 5/062* (2013.01); *B65H 1/04* (2013.01); *B65H 3/0684* (2013.01); *B65H 3/56* (2013.01);
(Continued)

(58) Field of Classification Search
CPC ..... B65H 3/0684; B65H 3/66; B65H 3/68; B65H 3/56; B65H 3/34; B65H 2301/51214
See application file for complete search history.

(56) References Cited

U.S. PATENT DOCUMENTS 5,700,002 A 12/1997 Kato et al.
6,276,677 B1 8/2001 Hommochi et al.
(Continued)

FOREIGN PATENT DOCUMENTS

JP 11-49377 A 2/1999
JP 2000-062989 A 2/2000
(Continued)

*Primary Examiner* — Luis A Gonzalez
(74) *Attorney, Agent, or Firm* — Venable LLP

(57) ABSTRACT

A sheet feeding apparatus includes a feeding rotating member to feed a sheet, and a separating portion to separate and feed one by one the sheet fed by the feeding rotating member. The separating portion includes a separating rotating member to feed a sheet and a separating member to form a separation nip portion by abutting on the separating rotating member. In addition, a sheet stacking portion on which sheets are stacked is disposed to face the feeding rotating member, and a sheet introducing portion guides the sheet toward the separating portion. The sheet introducing portion being is in a downstream side of the sheet stacking portion and positioned above a tangent line at a contacting point between the feeding rotating member and the sheet stacking portion in a vertical direction. A gap portion is disposed on the sheet introducing portion and outside of the feeding rotating member in a sheet width direction perpendicular to a sheet feeding direction and curves the sheet fed by the feeding rotating member in the sheet width direction.

8 Claims, 12 Drawing Sheets

(51) Int. Cl.
*B65H 5/06* (2006.01)
*B65H 1/04* (2006.01)
*B65H 3/56* (2006.01)

(52) U.S. Cl.
CPC ..... *B65H 3/68* (2013.01); *B65H 2301/51214* (2013.01); *B65H 2405/1412* (2013.01); *B65H 2405/3321* (2013.01); *B65H 2801/39* (2013.01)

(56) References Cited

U.S. PATENT DOCUMENTS

| | | | | |
|---|---|---|---|---|
| 7,686,291 | B2 * | 3/2010 | Miyazawa | B65H 3/06 271/117 |
| 7,866,658 | B2 * | 1/2011 | Bokelman | B65H 3/0684 271/117 |
| 7,992,861 | B2 * | 8/2011 | Furuya | B65H 3/5261 271/10.02 |
| 8,052,139 | B1 * | 11/2011 | Su | B65H 3/0684 271/109 |
| 8,770,575 | B2 * | 7/2014 | Yuasa | B65H 3/5223 271/121 |
| 8,953,230 | B2 | 2/2015 | Adachi | |
| 9,073,714 | B2 * | 7/2015 | Kim | B65H 3/0607 |
| 2013/0119601 | A1 * | 5/2013 | Wu | B65H 3/0669 271/117 |

FOREIGN PATENT DOCUMENTS

| | | | | |
|---|---|---|---|---|
| JP | 2006131324 | A * | 5/2006 | |
| JP | 2007126240 | A * | 5/2007 | |
| JP | 2007302380 | A * | 11/2007 | |
| WO | 2015087517 | A1 | 6/2015 | |
| WO | WO 2015087517 | A1 * | 6/2015 | B65H 1/04 |

* cited by examiner

SHEET FEEDING APPARATUS, IMAGE READING APPARATUS AND IMAGE FORMING APPARATUS WITH SHEET FEEDING APPARATUS

BACKGROUND OF THE INVENTION

Field of the Invention

The present invention relates to a sheet feeding apparatus which separates and feeds the sheets stacked on the sheet stacking portion one by one to convey the sheets to an image reading portion or an image forming portion, a sheet reading apparatus with the sheet feeding apparatus, and an image forming apparatus with the sheet feeding apparatus.

Description of the Related Art

For example, in an image reading apparatus in which plural sheets of originals are placed on an original stacking portion and these originals are separated and fed one by one to be read, the originals stacked on the original stacking portion are fed from the stacking position to the separating portion disposed downstream in the original conveying direction by a pick-up roller. A guide surface which extends from the original stacking portion to the separating portion is inclined so that the tip of an original is smoothly introduced to the separating portion.

The pick-up roller abuts on the uppermost original sheet of a bundle of originals when the uppermost original sheet is fed from the bundle of originals. In such a case, especially when a thin original sheet is fed, not only the uppermost sheet on which the pick-up roller abuts but also the sheets under the uppermost sheet are fed at the same time due to friction resistance between sheets. Thus, the tips of plural original sheets arrive at the separating portion from the stacking position.

In the system in which a separating pad is used, the separating pad abuts on a feed roller to form a separation nip in the separating portion. In the system in which a retard roller is used, the retard roller which rotates in the direction in which a sheet is returned abuts on the feed roller to form a separation nip in the separating portion. When plural originals are fed by the pick-up roller, the first original on which the feed roller abuts is fed but the second and subsequent originals under the first original are dammed by the separating pad or the retard roller so that only one original is fed (Japanese Patent Application Publication 2000-62989).

As explained above, when plural original sheets are fed to the separating portion, originals subsequent to the first original are dammed at the separation nip. However, after the tips of the subsequent originals are dammed by the separation nip, the feed of original sheets is performed in a certain amount and a conveying force is continuously applied to the sheets dammed at the separation nip by the pick-up roller. Thus, a thin original sheet having low stiffness is buckled, causing a conveyance failure.

SUMMARY OF THE INVENTION

An object of the present invention is to provide a sheet feeding apparatus which can prevent a sheet fed to the separating portion from being buckled, an image reading apparatus with the sheet feeding apparatus and an image forming apparatus having the sheet feeding apparatus.

A sheet feeding apparatus according to the present invention, comprising:

a feeding rotating member configured to feed a sheet;

a separating portion configured to separate and feed one by one the sheet fed by the feeding rotating member, the separating portion including a separating rotating member configured to feed a sheet and a separating member configured to form a separation nip portion by abutting on the separating rotating member; and a curving portion configured to curve a sheet fed to the separation nip portion by the feeding rotating member in a sheet width direction perpendicular to a sheet feeding direction.

In the present invention, even a thin sheet of which tip is dammed at the separating portion can be fed without buckling because stiffness is added to the sheet by making the sheet curved in the sheet width direction at the curving portion.

Further features of the present invention will become apparent from the following description of exemplary embodiments with reference to the attached drawings.

DESCRIPTION OF THE EMBODIMENTS

[First Embodiment] Hereinafter, a sheet feeding device according to an embodiment of the present invention will be explained with an image reading apparatus having the sheet feeding apparatus.

Figure 1:
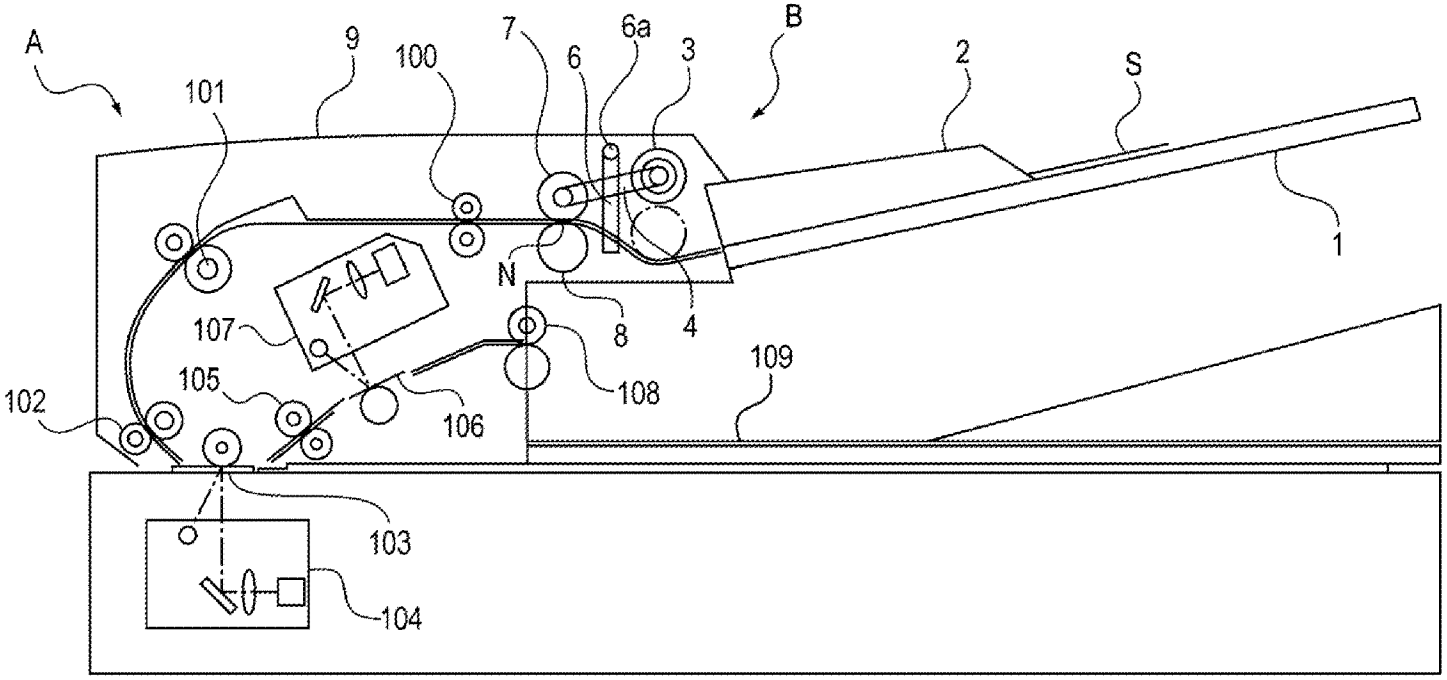
FIG. 1 is a diagram of a schematic cross-sectional view of an image forming apparatus according to an embodiment of the present invention.

<Reading Apparatus> FIG. 1 is an explanatory diagram of a schematic cross-sectional view of the image reading apparatus A according to the first embodiment. The configuration of the image reading apparatus A will be explained with the original reading operations. Plural original sheets (hereinafter referred to as sheets) are set on the stacking portion 1 for stacking sheets and these sheets are separated and fed one by one by the sheet feeding apparatus B which will be explained later. The information written on one side of each fed sheet is optically read by the first reading portion 104 when the sheet passes through on the first platen 103 with the conveyance of the pulling-out roller pair 100 and the conveying roller pair 101.

After that, the sheet is conveyed by the conveying roller pair 105 and the information written on the other side of the sheet is optically read by the second reading portion 107 when the sheet passes through on the second platen 106. And then, the sheet is discharged to the discharge portion 109 by the discharging roller pair 108.

<Sheet Feeding> Apparatus As shown in FIG. 1, the restricting member 2 which can slide in the sheet width direction (the direction perpendicular to the sheet conveying direction) is disposed on the stacking portion 1 of the sheet feeding apparatus on which the sheets S are stacked. The restricting member 2 is provided for aligning the positions of sheets in the width direction by restricting the position of the sheets S stacked on the stacking portion 1 in the width direction when the sheets are fed.

Further, the stacking portion 1 is equipped with the sheet stack detecting sensor (not shown) for detecting the stack of the sheets S on the stacking portion 1. In this embodiment, the sheet stack detecting sensor has the configuration in which the presence and absence of the sheet on the stacking portion 1 is detected by detecting the position of a sensor lever which rotates depending on the presence and absence of the sheet by a photo-interrupter. However, another known sensor configuration can be adopted.

Figure 2:
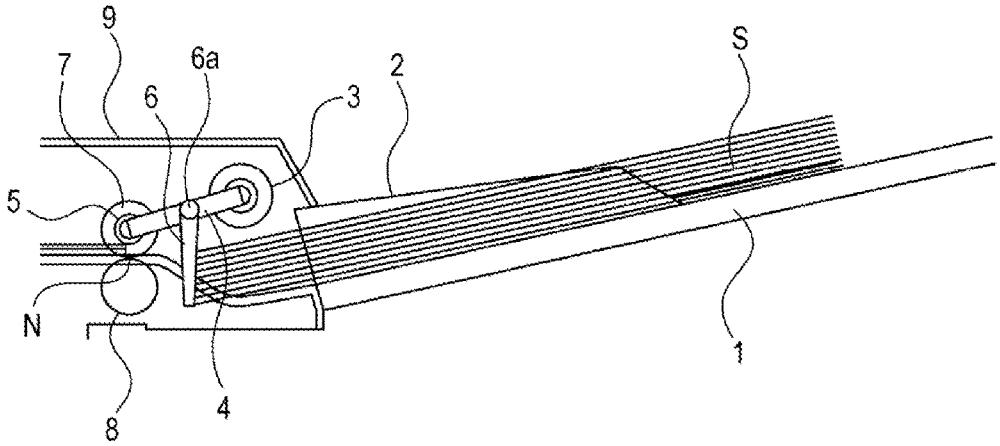
FIG. 2 is a diagram of a cross-sectional view of the image reading apparatus according to the embodiment of the present invention, showing the stand-by state of feeding a sheet.

(Pick-up roller) The pick-up roller 3 (feeding rotating member) which imparts feeding force to the sheets stacked on the stacking portion is provided at a downstream side with respect to the sheet feeding direction on the stacking portion 1. As shown in FIG. 2, the pick-up roller 3 is rotatably attached to one end of the supporting arm 4.

Figure 3:
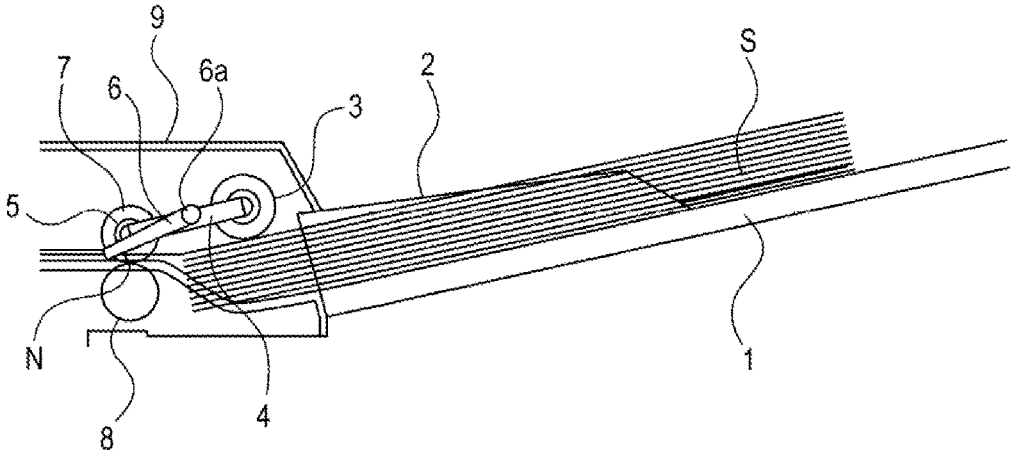
FIG. 3 is a diagram of a cross-sectional view of the image reading apparatus according to the embodiment of the present invention, showing the state of feeding a sheet.

The supporting arm 4 is a supporting member which supports the pick-up roller 3 such that the pick-up roller 3 can move between the feeding position and the stand-by position. The other end which is opposed to the end to which the pick-up roller 3 is attached is attached to the driving shaft 5 so that the supporting arm 4 can rotate about the driving shaft 5. When sheets are not fed, the pick-up roller 3 is moved to an upward position where it stands by. When sheets are set on the stacking portion 1 and a feeding signal is received, the driving shaft 5 rotates in the first direction so that the supporting arm 4 rotates about the driving shaft 5 in the clockwise direction as shown in FIG. 2 and the pick-up roller 3 is moved at the feeding position at which the pick-up roller 3 abuts on the sheets S stacked on the stacking portion 1 (See FIG. 3). On the other hand, when the driving shaft rotates in the second direction opposite to the first direction, the supporting arm 4 rotates about the driving shaft 5 in the counterclockwise direction as shown in FIG. 3 so that the pick-up roller 3 is lifted and moved to the stand-by position which is separated from the sheets S (See FIG. 2).

(Shutter member) The shutter member (restricting portion) 6 which restricts the position of the tip of the sheet set on the stacking portion 1 is provided at the downstream side in the sheet feeding direction with respect to the pick-up roller 3. The shutter member 6 is provided rotatably about the axis 6*a* provided on the opening and closing cover 9. When the pick-up roller 3 is at the stand-by position, the shutter member 6 is located at the restricting position shown in FIG. 2 and plays a role for damming the sheets S by abutting to the tips of the sheets stacked on the stacking portion 1 so that the sheets S cannot be pushed over the predetermined position. Further, when the pick-up roller 3 is moved to the feeding position, the shutter member 6 rotates to the non-restricting position shown in FIG. 3 at which the sheets can be fed.

Figure 4A:
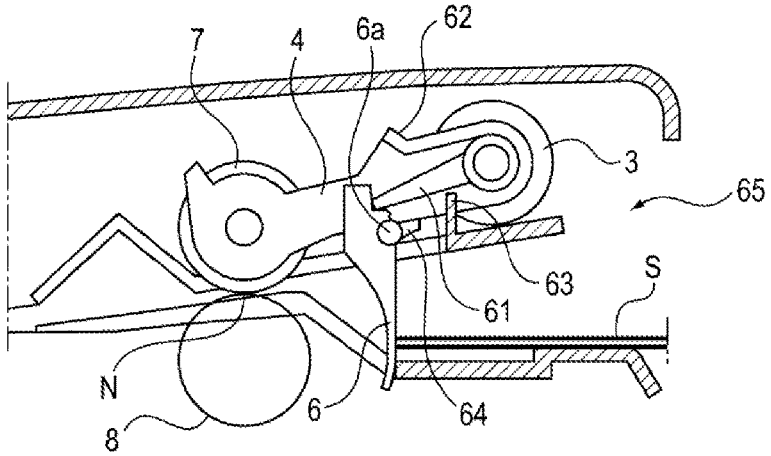
FIGS. 4A to 4D are diagrams for explaining the operations of a shutter member of the image reading apparatus according to the embodiment of the present invention.
Figure 4B:
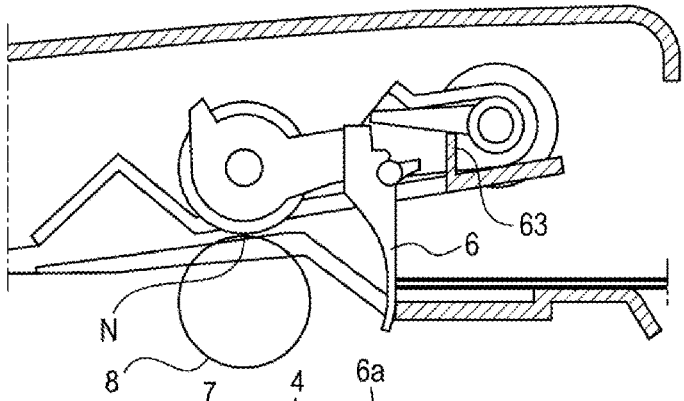

The configuration of the shutter member 6 will be explained with operations in reference to FIGS. 4A to 4D. FIG. 4A shows the state in which the sheets S are stacked on the stacking portion 1. In this figure, the pick-up roller 3 is at the stand-by position which is located at an upper position. In this case, the shutter member 6 is at the position (the position in which the tip of the sheet is restricted) at which the shutter member 6 blocks the sheet feeding opening 65 and the sheets are dammed. Further, at this position, the rotation of the shutter member 6 to the sheet feeding direction is restricted by the stopper 61 which is freely rotatably attached to the axis of the pick-up roller 3. When the sheets advance to the sheet feeding opening 65 in this state, the tips of the sheets S bump into one end of the shutter member 6 so that further advance of the sheets are prevented and the sheets are stacked at an appropriate position on the stacking portion 1.

Thereafter, when the pick-up roller 3 goes down by a sheet feeding signal, the stopper 61 which restricts the shutter member 6 by abutting on it abuts on the protruding portion 63 provided on the upper side guide of the sheet feeding opening 65 so that the stopper 61 rotates in the upward direction. By this operation, the stopper 61 is separated from the shutter member 6 and the restriction in the sheet feeding direction is released (See FIG. 4B).

Figure 4C:
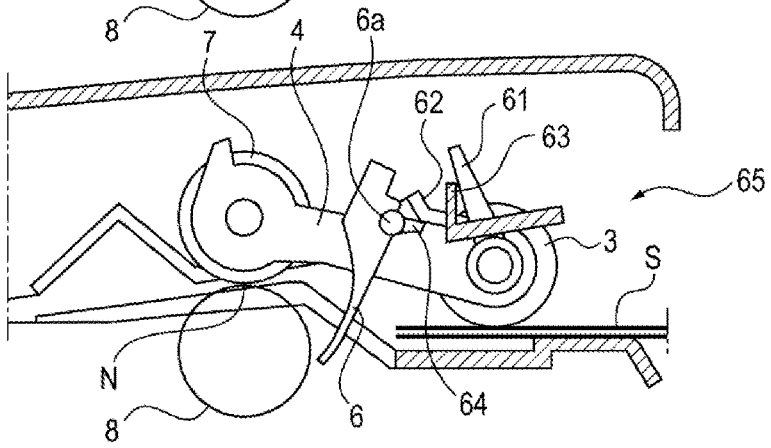
Figure 4D:
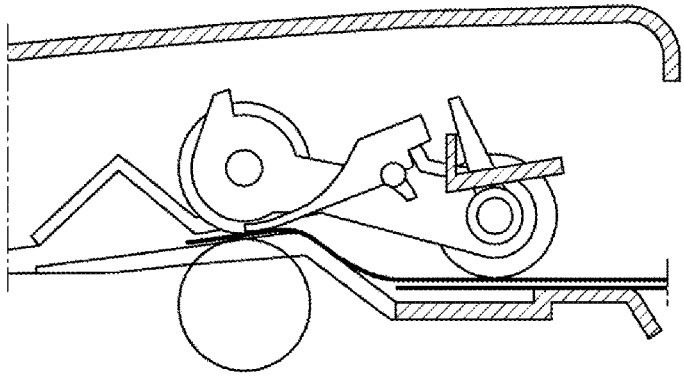

When the pick-up roller 3 goes down in a certain amount, the engaging protruding portion 64 of the shutter member 6 abuts on the protruding portion 62 provided on the supporting arm 4 so that the shutter member 6 rotates in a certain amount and is inclined in the sheet feeding direction (See FIG. 4C). At this time, the shutter member 6 is suspended by its own weight and the rotation to the upstream side in the sheet feeding direction is restricted by the protruding portion 62 at the position where the shutter member 6 has rotated in a certain amount and is inclined. Thus, the shutter member 6 is maintained such that the shutter member 6 is inclined.

When the pick-up roller 3 abuts on the uppermost sheet on the stacking portion 1 and the sheet is fed to the separating portion by rotation of the pick-up roller 3, the tip of the fed sheet pushes the shutter member 6 to the position at which the sheet S can pass through. By this operation, the sheet S is conveyed over the position of the shutter member 6 to the separating portion (See FIG. 4D). At this time, the tip of the shutter member 6 is in contact with the upper surface of the fed sheet by its own weight.

When the pick-up roller 3 moves from the feeding position to the stand-by position, the shutter member 6 rotates about the axis 6*a* by its own weight and returns to the restricting position shown in FIG. 4A.

(Separating portion) The separation portion for separating one by one the sheets S fed by the pick-up roller 3 is provided at the downstream side in the sheet feeding direction with respect to the shutter member 6. The separating portion includes the conveying roller 7 (separating rotating member) for conveying the fed sheet downstream and the separating roller 8 (separating member) for forming the separation nip portion N by abutting on the conveying roller 7.

A torque limiter (not shown) is coaxially disposed on the separating roller 8. When two or more sheets are about to enter the separation nip portion N, break is applied to the separating roller 8 by the torque limiter and the tip of the sheet which is not in contact with the conveying roller 7 is dammed. By this operation, even if the sheets are fed in a bundle state by the pick-up roller 3, the sheets are separated one by one and only the uppermost sheet of the sheet bundle is fed.

When the tip of one separated sheet arrives at the pulling-out roller pair 100 disposed downstream with respect to the separating roller, the driving of the conveying roller 7 and the pick-up roller 3 is stopped and the sheet is conveyed by the pulling-out roller pair 100 such that the sheet is pulled out from the separation nip portion. While the sheet is being conveyed by the pulling-out roller pair 100, the tip of the bundle of sheets under the sheet which is being conveyed is kept at the position upstream with respect to the separation nip portion N.

Figure 5:
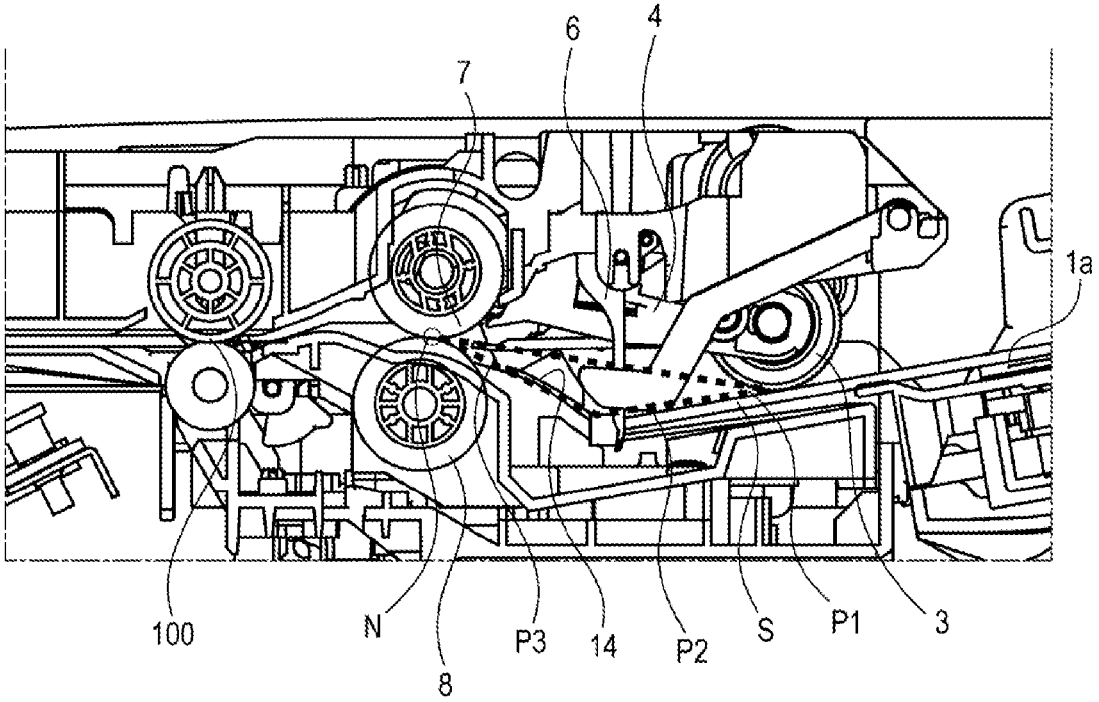
FIG. 5 is a diagram of a front side cross-sectional view of a feeding and separating portion according to the embodiment of the present invention.

(Sheet introducing portion from sheet stacking portion to separating portion) As shown in FIG. 5, the sheet stacking surface la of the stacking portion 1 is located at a position lower than the separation nip portion N and when a large number of sheets are stacked on the stacking portion, the sheets are fed substantially horizontally. When a small number of sheets S are set on the stacking portion 1, the sheets S set on the sheet stacking surface la disposed on the sheet stacking portion below the conveying roller 7 arrive at the separation nip portion N from the stacking position along the pre-separation slope 14 which is an introducing portion for introducing the tips of the sheets from the sheet stacking position to the separation nip portion N when the sheets S are conveyed by the pick-up roller 3.

When the mutual adhesiveness of the sheets set on the sheet stacking portion is high, plural sheets including the uppermost sheet among the sheets S are fed by pick-up roller 3 as a bundle of sheets and the tip of the bundle of sheets arrives at the separation nip portion N. Only the uppermost sheet of the bundle of sheets which arrived at the separation nip portion N is conveyed downstream from the conveying roller 7 and the sheets under the uppermost sheet are dammed with the tips of the sheets being positioned at the separation nip portion N.

While a sheet is being conveyed by the conveying roller 7, when a deflection is generated on the sheet S between the pick-up roller 3 and the conveying roller 7, the sheet may be damaged. Thus, when a sheet is conveyed by the conveying roller 7, the conveying speed of the conveying roller 7 is set to be greater than the conveying speed of the pick-up roller 3 by about 2 to 3 percent in order for the deflection not to generate on the sheet between the pick-up roller 3 and the conveying roller 7. Thus, when a sheet is conveyed by the conveying roller 7, the sheet is in a linear shape between the conveying roller 7 and the pick-up roller 3 as shown by the dotted line P1 of FIG. 5.

Figure 6:
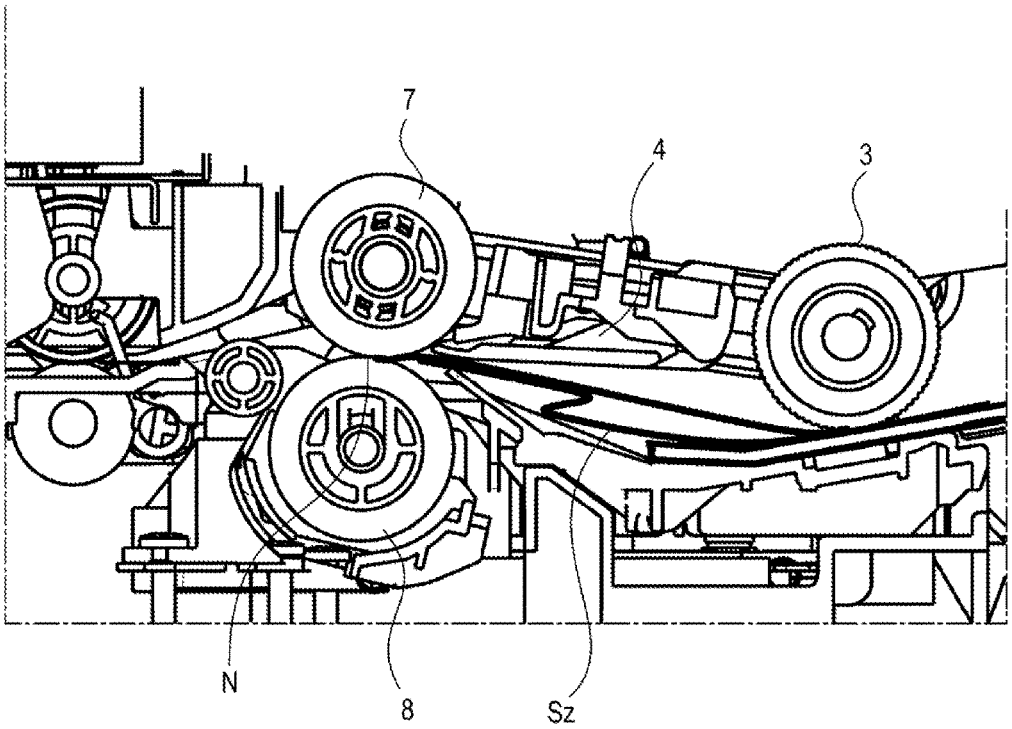
FIG. 6 is a diagram of a front side cross-sectional view of a feeding and separating portion according to the embodiment of the present invention.

At this time, while the uppermost sheet of the bundle of the sheets is being conveyed, the pick-up roller 3 rotates. Thus, as explained above, when the mutual adhesiveness of the sheets is high, the sheet under the uppermost sheet is taken by the uppermost sheet and is conveyed to the conveying roller 7. At this time, when the stiffness of the sheet is low such as a thin sheet, the tip of the sheet is dammed at the separation nip portion N and the sheet buckles in the triangle formed by the dotted lines P1, P2 and P3 as shown in FIG. 5 so that the sheet is easy to deflate in the shape of letter Z as shown by the sheet Sz in FIG. 6.

Figure 7:
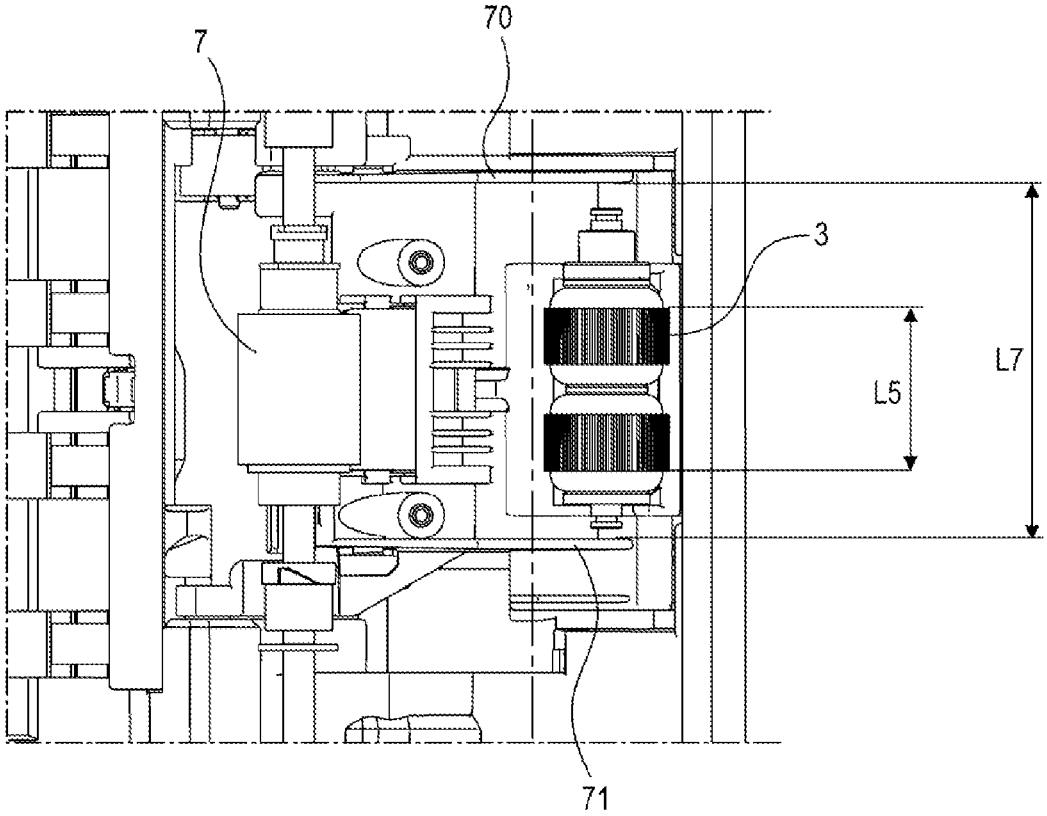
FIG. 7 is a diagram of a top view of a feeding and separating portion according to the embodiment of the present invention.
Figure 8:
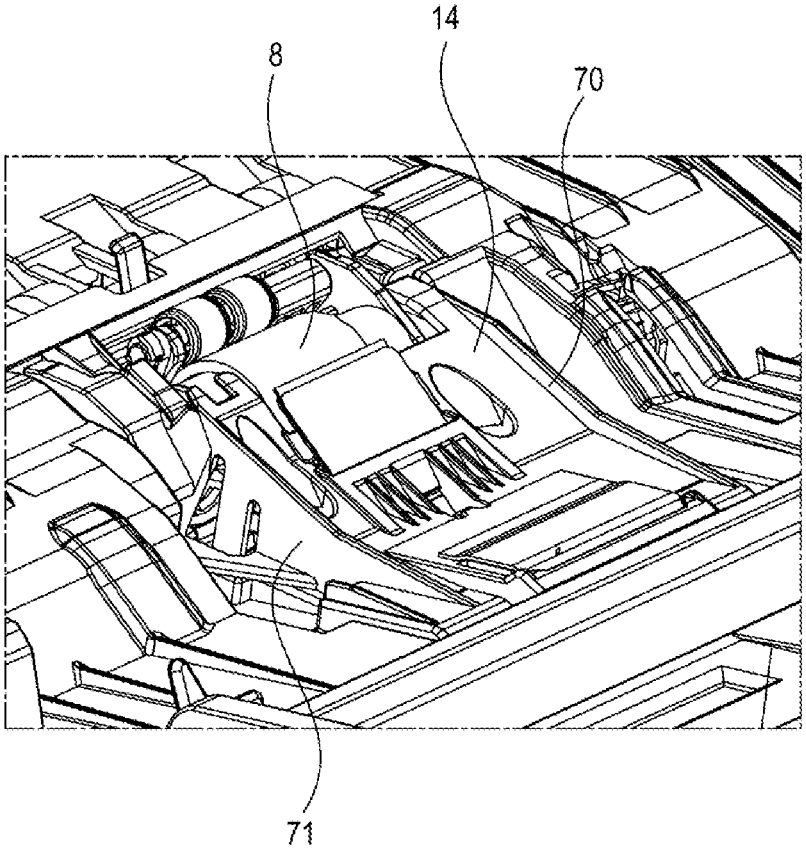
FIG. 8 is a diagram of a perspective view of a lower side of a feeding and separating portion according to the embodiment of the present invention.

(Curving portion) In the present embodiment, as shown in FIGS. 7 and 8, two ribs 70 and 71 are provided on the pre-separation slope 14 disposed between the pick-up roller 3 and the conveying roller 7 with the mutual width interval L7 wider than the length L5 of the pick-up roller 3 in the sheet width direction such that the ribs 70 and 71 protrude from the pre-separation slope 14. The ribs 70 and 71 are protruding members provided along the sheet feeding direction between the pick-up roller 3 and the separation nip portion N and constitute a curving portion which curves in the sheet width direction the sheet fed to the separation nip portion N by the pick-up roller 3. In the present embodiment, two ribs are provided such that a rib is provided on each side of the pick-up roller in the sheet width direction respectively. However, more than two ribs may be provided. For example, four ribs may be provided such that two ribs are disposed on each side of the pick-up roller 3.

The ribs 70 and 71 are disposed such that the abutting of the ribs 70 and 71 on a sheet begins at the position downstream with respect to the abutting position at which the pick-up roller 3 abuts on the sheet so that the sheet is introduced to the separation nip portion N.

Figure 9:
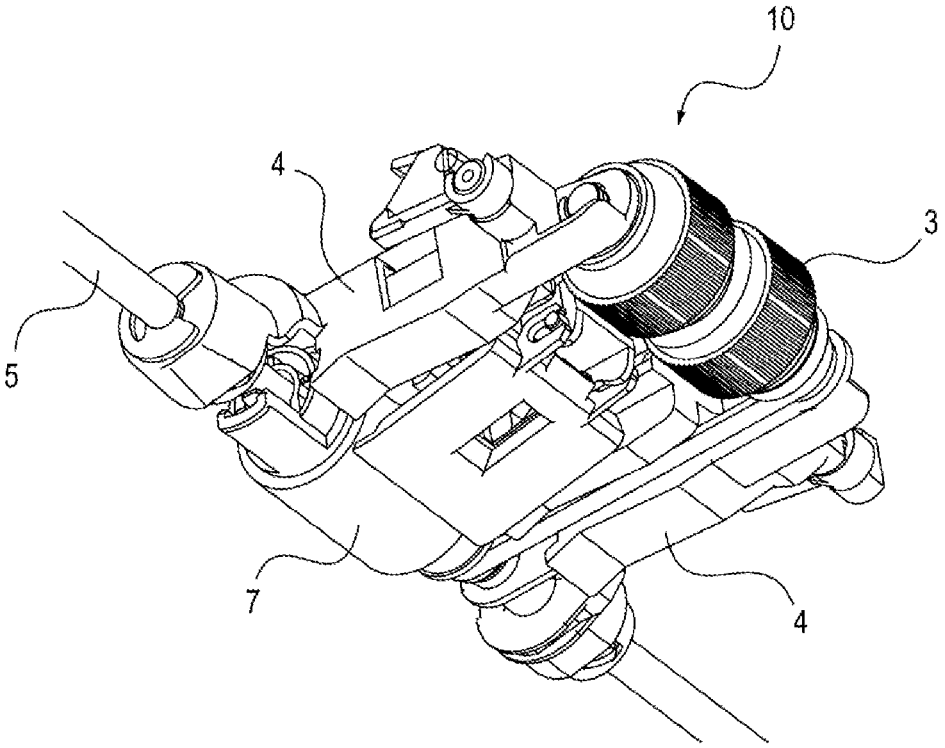
FIG. 9 is a diagram of a perspective view of a lower side of a feeding and separating portion according to the embodiment of the present invention.

The pick-up unit 10 is disposed such that the two supporting arms 4 which support the pick-up roller 3 are positioned above the ribs 70 and 71 between the pick-up roller 3 and the conveying roller 7. Thus, as shown in FIG. 9, the lower surface of the supporting arm 4 which is opposed to the ribs 70 and 71 works as a conveying guide portion for smoothly conveying a sheet fed by the pick-up roller 3.

The shutter member 6 is disposed outside the ribs 70 and 71 in the sheet width direction. With this configuration, the lower surface of the sheet fed to the separating portion is supported by the ribs 70 and 71, and uplift of the sheet is suppressed by the weight of the shutter member 6 outside the sheet width direction.

Figure 10:
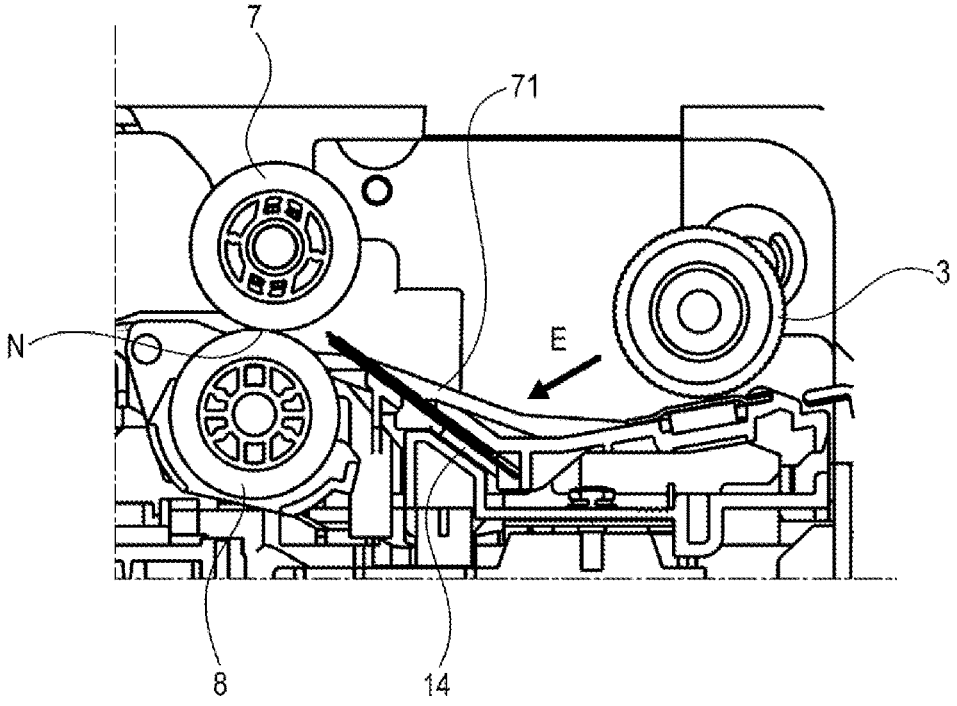
FIG. 10 is a diagram of a front side cross-sectional view of a feeding and separating portion according to the embodiment of the present invention.

In the above configuration, for the case where the sheets having a low stiffness enter at the separation nip portion N as a bundle state and further the sheets are pushed by the conveying force in the direction of the arrow E in FIG. 10 by the pick-up roller 3, the pre-separation slope 14 has a surface which is different from the sheet stacking surface and which has a certain angle with respect to the sheet stacking surface. Namely, the certain angle is set such that the sheet S fed along the stacking surface in the diagonally downward direction by the pick-up roller 3 is fed along the pre-separation slope 14 in the diagonally upward direction. By this configuration, the force for feeding the sheet bundle is also used for pressing the sheet bundle to the pre-separation slope 14.

Figure 11:
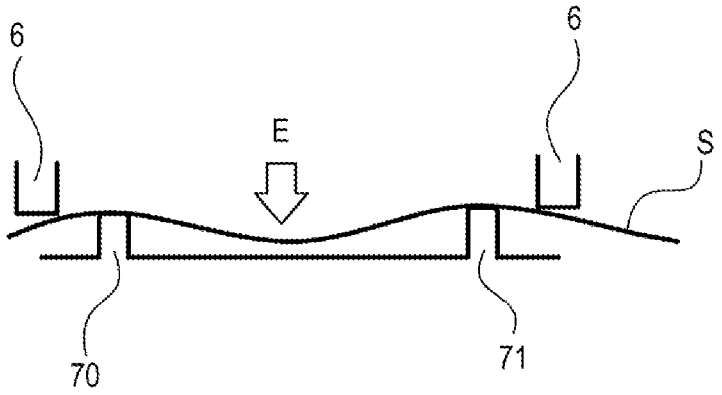
FIG. 11 is a diagram of a schematic cross-sectional view of a pre-separation slope when a sheet is being fed according to the embodiment of the present invention.

Because the ribs 70 and 71 are disposed outside the pick-up roller 3 in the sheet width direction, when the sheet is pushed by the pick-up roller 3 in the direction of the arrow E in FIG. 10, the sheet is pressed to the pre-separation slope 14 as shown in FIG. 11 by the force. At this time, the sheet S is supported by the ribs 70 and 71 at the positions wider than the pick-up roller 3. Thus, the sheet S is curved in the sheet width direction between the ribs 70 and 71. With this configuration, longitudinal stiffness is given to the sheet in the direction of feeding the sheet. FIG. 11 is a diagram of a schematic cross-sectional view of the pre-separation slope 14 when a sheet is being fed.

Because the shutter member 6 is disposed outside the ribs 70 and 71 in the sheet width direction as shown in FIG. 11, the sheet of which edge portions are lifted by being pushed by the ribs 70 and 71 is pressed by the shutter member 6.

With this configuration, the sheet is curved in the opposite direction and the longitudinal stiffness becomes higher.

As explained above, even if the sheet bundle which is dammed with the tip of the sheet bundle being positioned at separation nip portion N is given a feeding force and pushed by the pick-up roller 3, the shape of the sheet is kept by the longitudinal stiffness to prevent the sheet from buckling. Thus, a feeding failure of the sheet between the pick-up roller 3 and the separation nip portion N can be prevented.

The supporting arm 4 which supports the pick-up roller 3 is disposed above the ribs 70 and 71 and the surface which is opposed to the ribs works as a conveying guide surface. Thus, the sheet lifted by the ribs 70 and 71 is pressed by the conveying guide surface.

Figure 12:
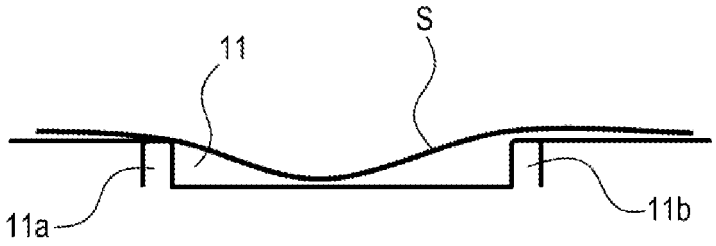
FIG. 12 is a schematic diagram showing a state in which a sheet is fed according to another embodiment of the present invention.

<Other Embodiments> Although, in the above embodiment, the example of the configuration is explained in which two ribs 70 and 71 are used as the curving portion which curves the fed sheet in the sheet width direction, the configuration in which ribs are not used can also be adopted. For example, in the configuration in which the sheet stacking surface is positioned below the separation nip portion and a sheet is fed to the separation nip portion along the pre-separation slope which has an angle different from that of the sheet stacking surface, the recessed portion 11 which is recessed from the other surface may be formed on the pre-separation slope 14 as shown in FIG. 12. The recessed portion 11 is formed in a recessed shape such that it is wider than the width of the pick-up roller and it is narrower than the fed sheet width in the sheet width direction.

When the sheet S fed by the pick-up roller 3 passes through the recessed portion 11, the pressing force is exerted toward the bottom portion of the recessed portion 11 similarly to the above embodiment. Thus, the sheet is supported by the brims 11*a* and 11*b* of the recessed portion 11 so that the sheet is curved in the sheet width direction. Thus, longitudinal stiffness is given in the sheet feeding direction thereby feeding a thin sheet without buckling.

Although, in the above embodiment, the example of the configuration is explained in which the separating portion is constituted of the conveying roller 7 and the separating roller 8, another configuration can be employed in which the separation nip portion is formed by a separating pad which abuts on the conveying roller which conveys the sheet. Still another configuration can also be employed in which the separation nip portion is formed by a feed roller which rotates in the sheet feeding direction and a retard roller which rotates in the direction in which a sheet is returned.

In the above embodiment, as the sheet feeding apparatus, an image reading apparatus is illustrated which reads the information of an original after the original is fed to the reading portion. However, the sheet feeding apparatus can be applied to an image forming apparatus such that a sheet is fed to the image forming portion by the sheet feeding apparatus and an image is formed on the sheet at the image forming portion.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2015-175812, filed Sep. 7, 2015, which is hereby incorporated by reference herein in its entirety.

What is claimed is:

1. A sheet feeding apparatus comprising:

a feeding rotating member configured to feed a sheet;

a separating portion configured to separate and feed one by one the sheet fed by the feeding rotating member, the separating portion including a separating rotating member configured to feed a sheet and a separating member configured to form a separation nip portion by abutting on the separating rotating member;

a sheet stacking portion on which sheets are stacked and disposed to face the feeding rotating member;

a sheet introducing portion configured to guide the sheet toward the separating portion, the sheet introducing portion being disposed in a downstream side of the sheet stacking portion and positioned above a tangent line at a contacting point between the feeding rotating member and the sheet stacking portion in a vertical direction; and a contact member disposed to be able to contact with an upper surface of the sheet conveyed by the feeding rotating member in a region of the sheet introducing portion, wherein the sheet introducing portion comprises a rib disposed along a sheet conveying direction, wherein the rib is positioned outside of the feeding rotating member in a sheet width direction perpendicular to the sheet conveying direction, and wherein the contact member is positioned at an opposite side of the feeding rotating member with respect to the rib in the sheet width direction, and wherein, in a cross-section, in the sheet width direction, involving the contact member and the rib, (a) a highest portion of the rib is higher than a surface of the sheet introducing portion corresponding to the feeding rotating member in the sheet width direction, and (b) a lowest portion of the contact member in a status that the sheet is not conveyed is lower than the highest portion of the rib.

2. The sheet feeding apparatus according to claim 1, wherein the rib includes a first rib and a second rib, and wherein, in a sheet width direction, the first rib is disposed at one side of the feeding rotating member and the second rib is disposed at the other side of the feeding rotating member.

3. The sheet feeding apparatus according to claim 2, wherein the contact member includes a first contact member and a second contact member, and wherein, in a sheet width direction, the first rib is disposed at an opposite side of the feeding rotating member with respect to the first contact member and the second rib is disposed at an opposite side of the feeding rotating member with respect to the second contact member.

4. The sheet feeding apparatus according to claim 1, further comprising a supporting portion configured to support the feeding rotating member, wherein the supporting portion includes a guide portion configured to guide a sheet fed by the feeding rotating member on a surface opposed to the rib.

5. The sheet feeding apparatus according to claim 1, wherein the rib is disposed such that the rib abuts on the sheet fed by the feeding rotating member downstream in the sheet feeding direction with respect to an abutting position at which the feeding rotating member abuts on the sheet.

6. The sheet feeding apparatus according to claim 1, wherein the contact member comprises a sheet regulating member for regulating a leading end of the sheet stacked on the stacking portion.

7. A sheet reading apparatus configured to feed a sheet and read information written on the sheet, the sheet reading apparatus comprising:

a sheet feeding apparatus; and a reading portion configured to read information written on the sheet fed by the sheet feeding apparatus, wherein the sheet feeding apparatus includes:

(1) a feeding rotating member configured to feed a sheet;

(2) a separating portion configured to separate and feed one by one the sheet fed by the feeding rotating member, the separating portion including a separating rotating member configured to feed a sheet and a separating member configured to form a separation nip portion by abutting on the separating rotating member;

(3) a sheet stacking portion on which sheets are stacked and disposed to face the feeding rotating member, (4) a sheet introducing portion configured to guide the sheet toward the separating portion, the sheet introducing portion being disposed in a downstream side of the sheet stacking portion and positioned above a tangent line at a contacting point between the feeding rotating member and the sheet stacking portion in a vertical direction, and (5) a contact member disposed to be able to contact with an upper surface of the sheet conveyed by the feeding rotating member in a region of the sheet introducing portion, wherein the sheet introducing portion comprises a rib disposed along a sheet conveying direction, wherein the rib is positioned outside of the feeding rotating member in a sheet width direction perpendicular to the sheet conveying direction, and wherein the contact member is positioned at an opposite side of the feeding rotating member with respect to the rib in the sheet width direction, wherein, in a cross-section, in the sheet width direction, involving the contact member and the rib, (a) a highest portion of the rib is higher than a surface of the sheet introducing portion corresponding to the feeding rotating member in the sheet width direction, and (b) a lowest portion of the contact member in a status that the sheet is not conveyed is lower than the highest portion of the rib.

8. An image forming apparatus configured to feed a sheet and form an image on the sheet, the image forming apparatus comprising:

a sheet feeding apparatus; and an image forming portion configured to form an image on the sheet fed by the sheet feeding apparatus, wherein the sheet feeding apparatus includes:

(1) a feeding rotating member configured to feed the sheet;

(2) a separating portion configured to separate and feed one by one the sheet fed by the feeding rotating member, the separating portion including a separating rotating member configured to feed a sheet and a separating member configured to form a separation nip portion by abutting on the separating rotating member;

(3) a sheet stacking portion on which sheets are stacked and disposed to face the feeding rotating member, (4) a sheet introducing portion configured to guide the sheet toward the separating portion, the sheet introducing portion being disposed in a downstream side of the sheet stacking portion and positioned above a tangent line at a contacting point between the feeding rotating member and the sheet stacking portion in a vertical direction, and (5) a contact member disposed to be able to contact with an upper surface of the sheet conveyed by the feeding rotating member in a region of the sheet introducing portion;

wherein the sheet introducing portion comprises a rib disposed along a sheet conveying direction, wherein the rib is positioned outside of the feeding rotating member in a sheet width direction perpendicular to the sheet conveying direction, and wherein the contact member is positioned at an opposite side of the feeding rotating member with respect to the rib in the sheet width direction, and wherein, in a cross-section, in the sheet width direction, involving the contact member and the rib, (a) a highest portion of the rib is higher than a surface of the sheet introducing portion corresponding to the feeding rotating member in the sheet width direction, and (b) a lowest portion of the contact member in a status that the sheet is not conveyed is lower than the highest portion of the rib.

* * * * *